US005251526A

United States Patent [19]

Hill

[11] Patent Number: 5,251,526

[45] Date of Patent: Oct. 12, 1993

[54] ROTATING ELECTRICAL STRINGED INSTRUMENT

[76] Inventor: Jason P. Hill, 2947 Wyandot, Denver, Colo. 80211

[21] Appl. No.: 917,368

[22] Filed: Jul. 23, 1992

[51] Int. Cl.[5] ..... G10D 1/00

[52] U.S. Cl. ..... 84/263; 84/267; 84/291; 84/293; 84/327

[58] Field of Search ..... 84/291, 292, 293, 327, 84/267, 268, 263

[56] References Cited

U.S. PATENT DOCUMENTS

| | | | |
|---|---|---|---|
| D. 293,687 | 1/1988 | Nichols | 84/327 |
| 1,723,751 | 8/1929 | Turturro | 84/263 |
| 3,447,412 | 6/1969 | Marshall | 84/291 |
| 3,636,809 | 1/1972 | Ezaki | 84/263 |
| 4,953,435 | 9/1990 | Chapman | 84/293 |
| 4,981,063 | 1/1991 | Roberts | 84/267 |

*Primary Examiner*—Michael L. Gellner
*Assistant Examiner*—Cassandra Spyrou

[57] ABSTRACT

A multi faced electric stringed musical instrument mounted on a single axle at rear end of straight through neck. A mechanical rotary device is attached to a separate open faced multi planar body which the axle runs through. Shoulder strap is mounted to top and bottom ends of body and then worn as a conventional guitar. This separate stationary body keeps the straight thru neck away from artist's body in proper playing position, free to rotate in either direction.

Each face of the stringed instrument can be played independently or simultaneously with respect to each other.

6 Claims, 3 Drawing Sheets

ROTATING ELECTRICAL STRINGED INSTRUMENT

BACKGROUND OF THE INVENTION

1. Field of the Invention

The invention relates in general to stringed musical instruments and in particular to the electric guitar and, or, the electric bass guitar.

2. Prior Art

In the last half century the electric guitar and bass have become an ever increasing popular means of musical expression. In terms of musical instruments the electric guitar/bass is a relatively new development. The arts industry has endeavored to keep up with the demand of quickly evolving techniques and demands of the artist.

One such endeavor is a guitar consisting of plural stringed instruments, e.g., two guitars. (see for example U.S. Pat. No. 2,222,959). In certain circumstances this type of guitar can be useful, e.g., where a band's personnel is limited and a piece of music needs more than one guitar playing. However each voice of this instrument must be played individually and therefore does not permit simultaneous multi voice play easily.

Later advancements in the arts industry were made by the creation of a double neck guitar enabling the artist to play two voices simultaneously. (see for example U.S. Pat. No. 4,240,319). However this type of instrument proves to be bulky and only one voice can be played per hand.

In an attempt to solve problems associated with configurations for multi voice stringed instruments, single neck multi voice instruments have been created by the arts industry. These attempts have included a combination bass and guitar with eight strings mounted on one face. (see for example U.S. Pat. No. 4,483,233). However this design changes the tuning of the guitar thus significantly altering traditional scale and chord structures. Furthermore the scale length of the bass would be the same as that of the guitar, thus it wouldn't produce a traditional bass sound. Another example exist of a bass and a guitar with 10 strings mounted on same neck. (see U.S. Pat. No. 4,377,101). Once again the scale lengths for the guitar and the bass are the same thus producing the same above described problem. Also the neck on the above described guitar proves to be rather bulky.

Other attempts have included a single neck guitar with a plurality of faces that rotate. (see for example U.S. Pat. No. 4,377,101). This guitar rotates on two bearings set at the top and bottom ends of neck. Although this instrument is useful for steel guitar, it substantially changes proper playing position for a standard guitar. Furthermore due to the bearings placement and lack of a body the guitar rest against the artist body hindering simultaneous multi voice play.

BRIEF DESCRIPTION OF THE INVENTION

Striving to correct these attendant problems, the present invention provides structure and function to enable individual and simultaneous multi voice play while maintaining proper playing position and balance. Other obvious advantages are that; the guitar and bass share some of the same tonal characteristics because they are on the same neck, the ability to play new chord structures and a wider tonal range offering infinite possibilities which new playing techniques will evolve from. Interestingly I discovered this quite by mistake while playing a conventional guitar. Like many guitarist, I often reach over the neck with my thumb to fret a note. I then turned the guitar with the string face towards my body and began playing this way. I then realized that if the guitar had a separate set of strings on the opposite side, and the neck could be kept away from the performers body, by then using my thumb new chords could be created.

DETAILED DESCRIPTION

Figure 1:
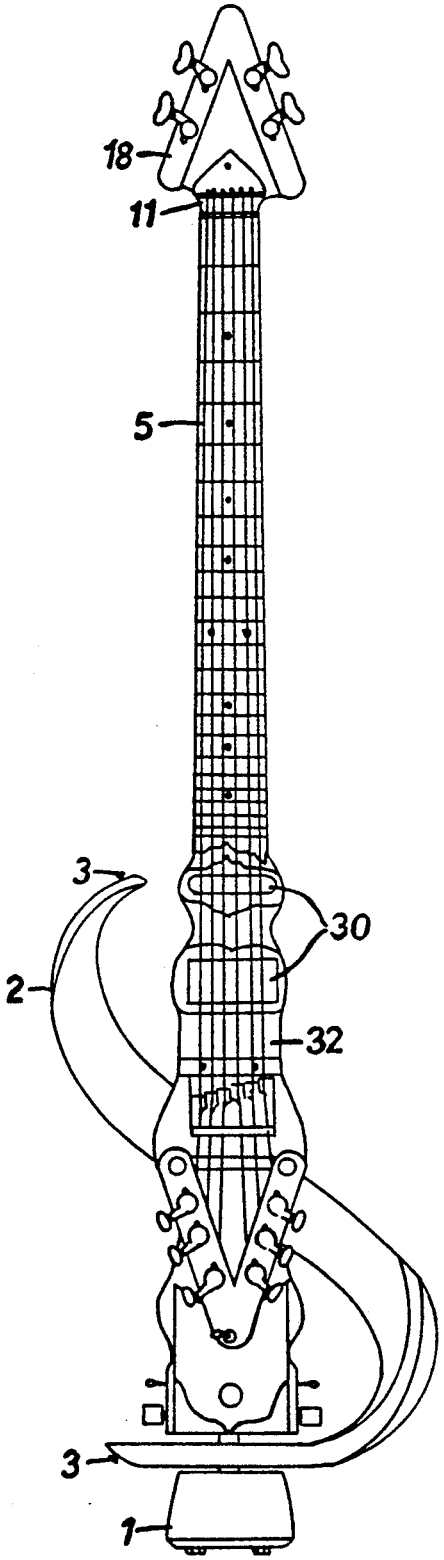
FIG. 1 is front view of body with guitar face.

The Rotar comprises a body 2 with one end situated between the jack box 1, and the bridge end of the straight thru neck 4. The body 2 is open faced and multi planar. The prototype body was constructed by glueing several veneer strips together and then bending to shape prior to glue setting. By curving away from and wrapping around the straight thru neck 4 the guitar body 2 rest against the performer's body. By slightly moving the guitar body 2, the curve is constructed to rest comfortably against the performer for both a bass and a guitar playing position. Because the body 2 is open faced it allows the performer to reach through to the straight thru neck 4 rather than over the body 2 thus further enhancing the playing position as well as permitting higher fretting on the finger boards 5,6. Furthermore, the body 2 enables the performer to play both faces 31,32 simultaneously with maximum comfort and enables the straight thru neck 4 to rotate freely without any obstructions.

The instrument is held to the performer by means of a strap which is attached to strap retainers 3 at both ends of the body 2 much like a conventional guitar, thus providing perfect balance and standard playing position.

The Rotar rotates by means of a mechanical rotary device 15 placed on body 2 at the bridge end of the straight thru neck 4. An axle 14 runs through the mechanical rotary device connecting the jack box 1 and the straight thru neck end 4. The electric wiring is contained within the axle 14. This mechanical rotary device 15 and axle 14 system allows rotation in either a clockwise or counter clockwise direction with either hand. During rotation the body 2 remains stationary, thus the position of the straight thru neck 4 in relation to the performers body will remain unchanged.

A highly desirable quality of a multi faced guitar is a thin straight thru neck. A thin straight thru neck allows the hands to reach both sets of the strings simultaneously. However a thin straight thru neck can compromise its strength. In order to compensate for any weakness I have placed a three component truss rod system extending through the complete neck length.

Figure 4:
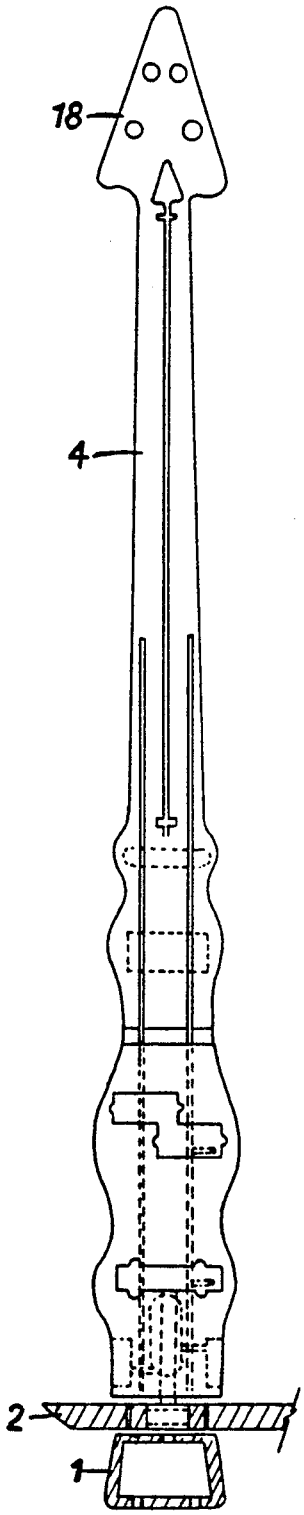
FIG. 4 is a view of bass side of straight thru neck showing interior of straight thru neck and a cut away of body and jack box.
Figure 5:
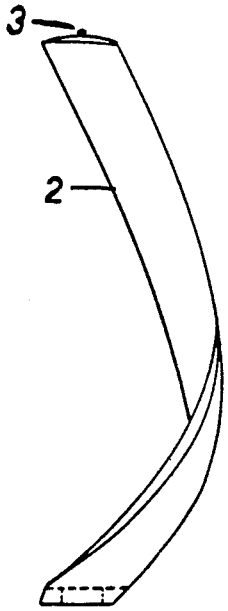
FIG. 5 is side view of body.
Figure 6:
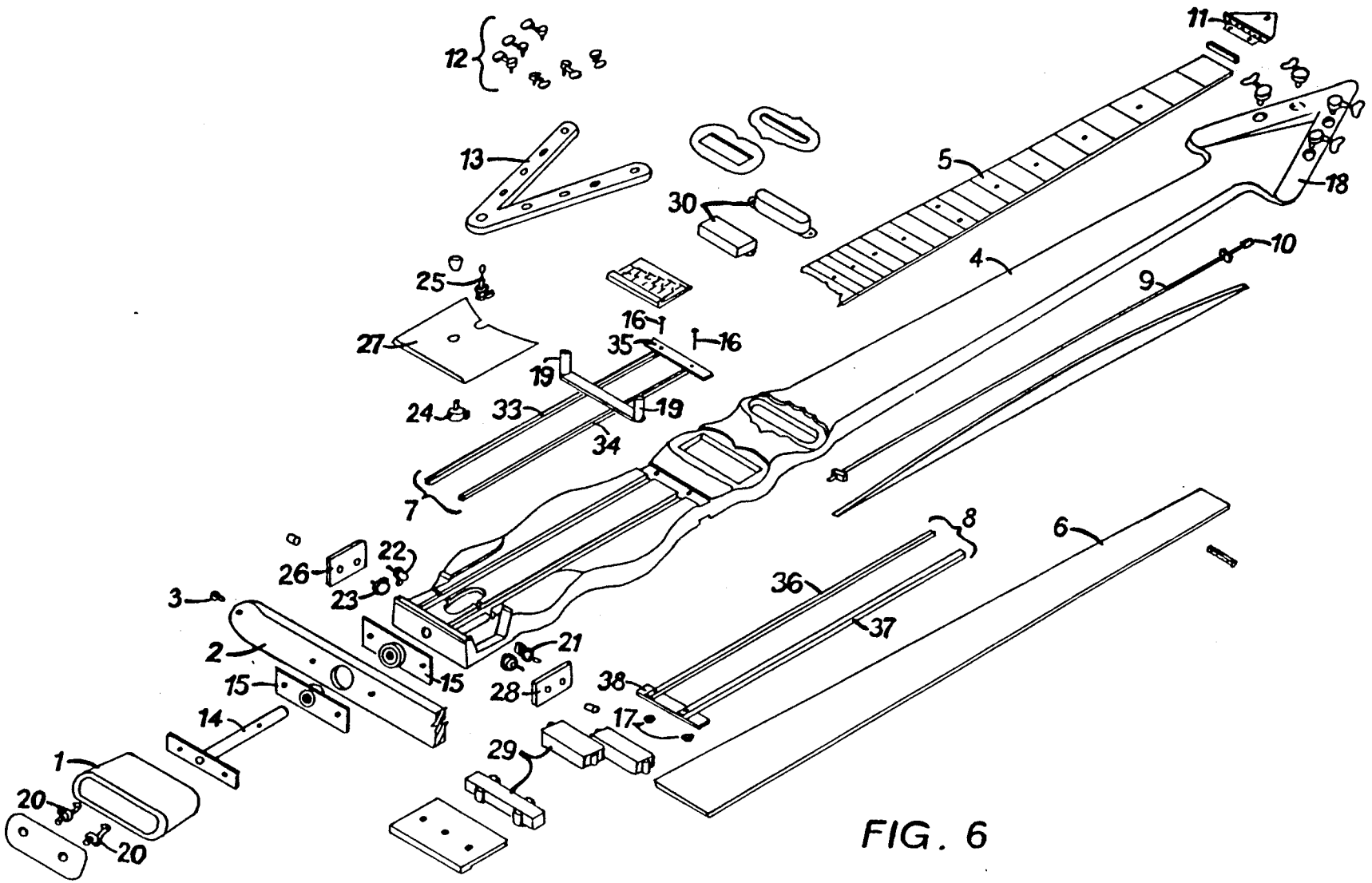
FIG. 6 is exploded view of the ROTAR.

The truss rods 7,8,9 are placed in routed slots which also contain wiring for the instrument, FIG. 4. The first truss rod 9 begins at the head 18 of the straight thru neck 4 and extends to fifteenth fret on bass fingerboard 6. A truss rod adjustment nut 10 is situated at the head 18 of the instrument on bass side 32. The above configuration differs little from that of a standard guitar. However, unlike conventional guitars, a pair of dual truss rod systems 7,8 extends from the bridge end of the straight thru neck 4 to seventh fret on bass fingerboard 6. Each truss rod system 7,8 comprises two truss rods 33,34,36,37 running parallel respective of each other, and separated by approximately one inch. One end of the truss rod system 7,8 is open, I will refer to this as the top end. The other end, the bottom end, consist of a metal plate 35,38 that is perpendicular to each truss rod 33,34,36,37 and is attached to the individual truss rod ends. As mentioned above, the top ends of the truss rod systems do not contain the above mentioned plates 35,38. The first truss rod system 8, begins at seventh fret on bass finger board 6 on the bass face 44 and ends at the end of the bass fingerboard 6. The second truss rod system 7, begins at the end of the straight thru neck 4 on the guitar face 32 and ends directly below the bottom end of truss rod system 8. The two truss rod systems 7,8 are then connected by two holes drilled on both plates 35,38 where truss rods meet plate. Two bolts 16 are then put through aligned holes and assembled with nuts 17. This bolt and nut system can be adjusted to compensate for minor changes in straight thru neck 4 alignment.

Figure 2:
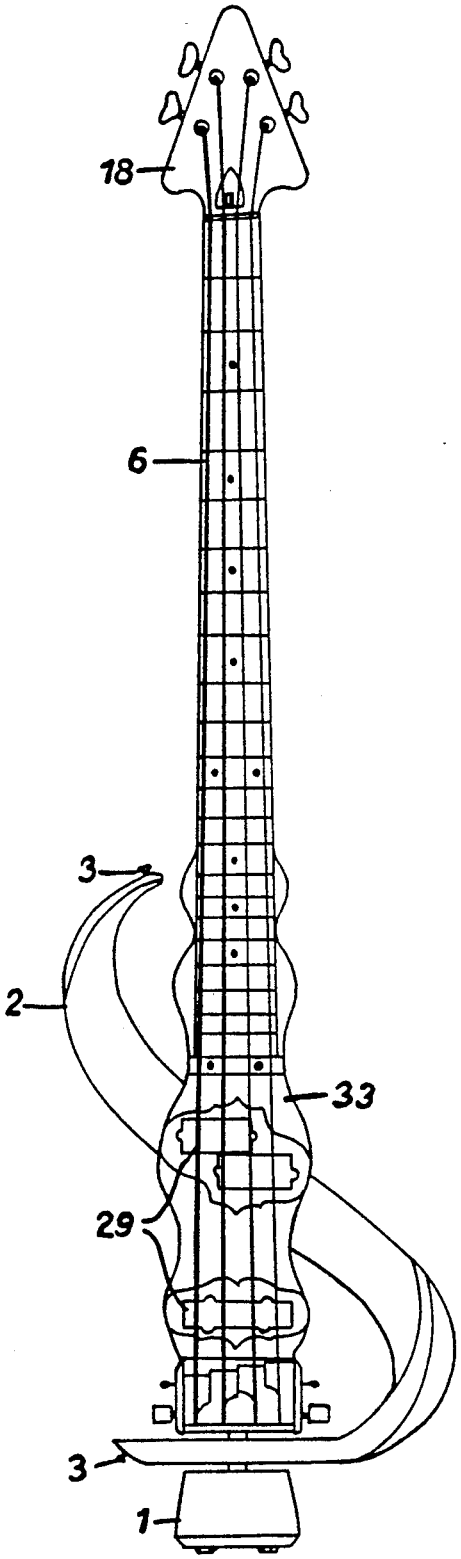
FIG. 2 is front view of body with bass face.
Figure 3:
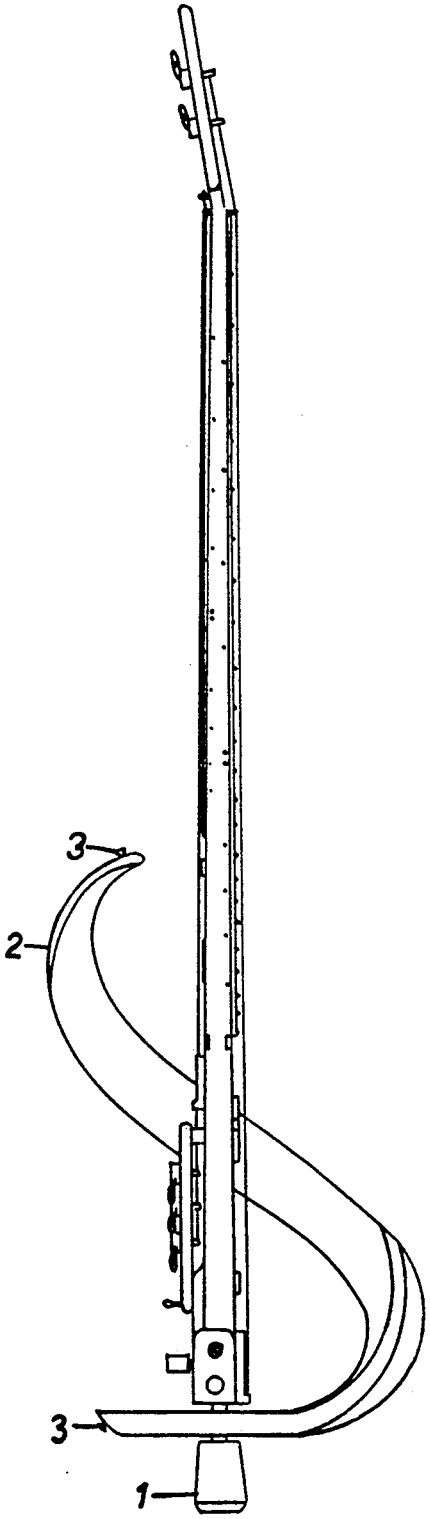
FIG. 3 is front view of body with side view of straight thru neck.

The bass FIG. 2 is strung the same as a conventional guitar. The guitar FIG. 1 is reverse strung. Rather than having both tuning boards on the head 18 of the straight thru neck 4, which would create an awkward balance, the tuning V board 13 for the guitar face 32 is attached to the lower end of the straight thru neck 4 by means of posts 19 mounted on truss rod system 7. Tuning keys 12 are then attached to the tuning V board 13. A string retainer 11 is mounted on head 18 of straight thru neck 4 on guitar face 32. This stringing configuration more evenly distributes the weight which therefore provides better balance.

There are two output jacks 20 one for the bass and one for the guitar, located in jack box 1. The jack box 1 is held in place by means of axle 14 which runs through center of jack box 1.

Wires from output jacks 20 run through axle 14 to guitar/bass selector switch 21 located on side of straight thru neck 4. This selector switch 21 controls multi voice or individual play, i.e., either the bass or the guitar can be played individually or simultaneously depending on mode of selector switch 21. A cover 28 attaches to straight thru neck 4 and helps contain switch 21. A volume control 23 for bass pick ups 29 is wired between bass/guitar selector switch 21 and individual bass pick up selector switch 22. Both bass pick up selector switch 22 and bass volume control 23 are placed opposite of guitar/bass selector switch on straight thru neck 4. A cover 27 attaches to straight thru neck 4 and helps contain the above mentioned parts, 21,22,23,24. Guitar pick up selector switch 25 runs through a hole in apex of tuning V board 13 on guitar face 32 of straight thru neck 4.

As this invention may be embodied in several forms without departing from its function and characteristic applications, the above described embodiment is illustrative and not restrictive. Since the scope of the invention is set for in the appended claims, any and all variations that fall within the bounds of claims or that provide same function or equivalents are intended to be embraced by those claims.

I claim:

1. A multi faced rotating stringed musical instrument in the nature of an electric guitar enabling simultaneous and individual multi voice play comprising: a straight thru neck comprising at least two sides wherein said neck is attached at one end to a multi planar body by means of a mechanical rotary device thereby enabling said straight thru neck to rotate in both a clockwise and counter clockwise direction.

2. The musical instrument of claim 1 wherein said body extends from said one end of said straight thru neck to a position proximate center of gravity of said straight thru neck; said body contains strap retaining devices located at top and bottom ends of said body enabling a shoulder strap to be attached.

3. The body of claim 2 wherein said body curves around and away from said straight thru neck.

4. The musical instrument of claim 1 wherein said straight thru neck comprises two faces, one guitar face and one bass face; wherein said faces consist of corresponding scale lengths for a bass and a guitar respectively.

5. The said straight thru neck of claim 4 wherein one face of said straight thru neck is reverse strung.

6. The said straight thru neck of claim 4 wherein said straight thru neck comprises a multi truss rod device comprising at least two truss rods; a first of said truss rods inset in a routed slot in said straight thru neck; wherein said slot begins at a first position proximate a bottom end of said guitar face and extends to a second position proximate a bottom end of said bass face; a second of said truss rods inset in a second routed slot in said straight thru neck; wherein said second slot begins at a third position proximate said bottom end of said bass face and extends to an opposite end of said straight thru neck; the second of said truss rods comprises a tensioning nut at said second position; said truss rods connected to said straight thru neck by means of a fastening device perpendicular to said straight thru neck.

* * * * *